US012458089B2

(12) United States Patent
Sthair

(10) Patent No.: US 12,458,089 B2
(45) Date of Patent: Nov. 4, 2025

(54) WEFT HAIR EXTENSION CLIPS AND ASSEMBLIES THEREOF

(71) Applicant: Hair Zone Inc., Moonachie, NJ (US)

(72) Inventor: Okyo Sthair, Tamarac, FL (US)

(73) Assignee: Hair Zone Inc., Moonachie, NJ (US)

( * ) Notice: Subject to any disclaimer, the term of this patent is extended or adjusted under 35 U.S.C. 154(b) by 296 days.

(21) Appl. No.: 17/248,040

(22) Filed: Jan. 6, 2021

(65) Prior Publication Data

US 2021/0120898 A1 Apr. 29, 2021

Related U.S. Application Data

(63) Continuation of application No. 29/697,926, filed on Jul. 12, 2019, now Pat. No. Des. 907,856.

(51) Int. Cl.
*A41G 5/00* (2006.01)

(52) U.S. Cl.
CPC ..... *A41G 5/0073* (2013.01)

(58) Field of Classification Search
CPC .. A41G 5/0006; A41G 5/0013; A41G 5/0026; A41G 5/004; A41G 5/0053; A41G 5/0073; A45D 8/12; A45D 8/14; A45D 8/24; A45D 8/26
See application file for complete search history.

(56) References Cited

U.S. PATENT DOCUMENTS 1,526,440 A 2/1925 Skaruda
4,155,370 A 5/1979 Nemoto
7,735,495 B2 6/2010 Lane et al.
D622,004 S 8/2010 Umezu et al.
D663,508 S 7/2012 Kaweblum
D680,273 S 4/2013 Hartwich
8,567,413 B2 10/2013 Lane
8,631,804 B2 1/2014 Aderans
8,689,807 B2 4/2014 Svenson
(Continued)

FOREIGN PATENT DOCUMENTS

CN 1611159 A 5/2005
CN 103747697 B 3/2016
(Continued)

OTHER PUBLICATIONS

Translation of KR 20-0483628 computer (Year: 2004).*
(Continued)

*Primary Examiner* — Rachel R Steitz
(74) *Attorney, Agent, or Firm* — Kim IP Law Group LLC

(57) ABSTRACT

A weft hair extension clip assembly, system, and method of using the same is provided. Each weft hair extension clip assembly has a planar base, along a first surface thereof the artificial weft hair is attached. On the second, opposing surface of the planar base is a frame joined thereto by opposing end caps for each clip of the weft hair extension assembly. Each end cap supports prongs movable between an inactive mode and an active mode, relative to the frame, where in the active mode the prongs intersect the plane of the frame in such a way as to urged hair of the user between the prongs and frame for a secure hold. The frame may also move in concert with the prongs from a convex configuration to a concave configuration hugging the head of the user in the active mode.

20 Claims, 6 Drawing Sheets

(56) References Cited

U.S. PATENT DOCUMENTS

| | | | | |
|---|---|---|---|---|
| D704,892 | S | 5/2014 | Haan | |
| D721,849 | S | 1/2015 | Monroe | |
| D721,857 | S | 1/2015 | Watson | |
| 9,010,341 | B1 | 4/2015 | Lee | |
| D732,742 | S | 6/2015 | Zephyr et al. | |
| 9,155,344 | B1 | 10/2015 | Romm | |
| 9,167,858 | B2 | 10/2015 | Lane | |
| D752,293 | S | 3/2016 | Lee | |
| D770,686 | S | 11/2016 | Mosley | |
| 10,010,125 | B1 | 7/2018 | Maman | |
| 10,085,505 | B2 | 10/2018 | Williams | |
| 10,575,576 | B2 | 3/2020 | Hayes | |
| 10,897,944 | B2 | 1/2021 | Romm | |
| 10,993,493 | B2 | 5/2021 | Kim et al. | |
| 11,013,279 | B2 | 5/2021 | Kawakita | |
| 11,026,460 | B2 * | 6/2021 | Taylor | A41G 5/0046 |
| 11,317,667 | B2 | 5/2022 | Pilosi et al. | |
| 2007/0131236 | A1 | 6/2007 | Wakisaka | |
| 2010/0235658 | A1 * | 9/2010 | Nishida | H04W 52/029 713/600 |
| 2013/0042881 | A1 | 2/2013 | Mutchler | |
| 2014/0326263 | A1 * | 11/2014 | Miyatake | A41G 3/00 132/54 |
| 2015/0223538 | A1 * | 8/2015 | Yanniello | A41G 5/0073 132/53 |
| 2016/0015107 | A1 * | 1/2016 | Sehovic | A41G 5/0073 132/201 |
| 2016/0050996 | A1 * | 2/2016 | Kwon | A41G 3/0033 132/54 |
| 2016/0150843 | A1 * | 6/2016 | Kim | A41G 5/0073 132/105 |
| 2017/0164674 | A1 * | 6/2017 | Rubenstein | A41G 5/0046 |
| 2018/0035738 | A1 * | 2/2018 | Hayes | A41G 5/0073 |
| 2020/0060369 | A1 * | 2/2020 | Fillerup | A41G 5/0073 |
| 2020/0383412 | A1 * | 12/2020 | Pilosi | A41G 5/006 |
| 2021/0274872 | A1 * | 9/2021 | Evans | A41G 5/0046 |

FOREIGN PATENT DOCUMENTS

| | | | |
|---|---|---|---|
| CN | 305005474 | | 1/2019 |
| CN | 305005475 | | 1/2019 |
| CN | 305116895 | | 4/2019 |
| EP | 2183988 | A2 | 5/2010 |
| EP | 3657972 | B1 | 11/2021 |
| GB | 1019301 | | 9/1984 |
| GB | 6076791 | | 9/1984 |
| GB | 3012207 | | 6/2003 |
| GB | 6073723 | | 10/2019 |
| GB | 6076552 | | 11/2019 |
| GB | 6076975 | | 11/2019 |
| JP | 5550917 | B2 | 7/2014 |
| JP | 6130473 | B2 | 5/2017 |
| KR | 300392313.0000 | | 9/2005 |
| KR | 300392314.0000 | | 9/2005 |
| KR | 300397066.0000 | | 10/2005 |
| KR | 20080006464 | U | 12/2008 |
| KR | 101170688 | B1 | 8/2012 |
| KR | 101258370 | B1 | 4/2013 |
| KR | 300816264.0000 | | 9/2015 |
| KR | 300818826.0000 | | 10/2015 |
| KR | 300819607.0000 | | 10/2015 |
| KR | 300842904.0000 | | 2/2016 |
| KR | 300888974.0000 | | 12/2016 |
| KR | 300896329.0000 | | 2/2017 |
| KR | 101722878 | B1 | 4/2017 |
| KR | 20-0483628 | * | 5/2017 |
| KR | 200483628 | Y1 | 6/2017 |
| KR | 300947110.0000 | | 3/2018 |
| KR | 300947111.0000 | | 3/2018 |
| KR | 101862837 | B1 | 5/2018 |
| KR | 300957185.0000 | | 5/2018 |
| KR | 300962137.0000 | | 6/2018 |
| KR | 300975294.0000 | | 9/2018 |
| KR | 300990282.0000 | | 2/2019 |
| KR | 300994555.0000 | | 2/2019 |
| KR | 300994556.0000 | | 2/2019 |
| KR | 301023906.0000 | | 9/2019 |
| KR | 102066238 | B1 | 1/2020 |
| WO | 201108085 | A1 | 1/2011 |

OTHER PUBLICATIONS

BNB Heaven "Invisible and Natural Fluffy Front Side Clip-In Bangs Hair Wig Extensions" Retrieved from: https://bootsnbagsheaven.com/products/invisible-and-natural-fluffy-front-side-clip-in-bangs-hair-wig-extensions?currency=USD&variant=41368681709745&utm_medium=cpc&utm_source=google&utm_campaign=Google%20Shopping&gc_id=17030307115&h_ad_id=594636172001&gclid=Cj0KCQjw.

The Hair Shop "Skinny Clip-In (Single Piece)" Retrieved from: https://www.thehairshop.com/skinny-clip-in-single-piece/?sku=N2BN18-000000826&gclid=Cj0KCQjw-JyUBhCuARIsANUqQ_IrXSw3kN03nXwByqHDtZIqNCRVpyiXNaJ3Kbu1_AQw47rp-u9UcJkaArWxEALw_wcB.

Best Wig Outlet "Add-On Human Hair Wiglet by Wig Pro" Retrieved from: https://www.bestwigoutlet.com/products/313e-h-add-on-human-hair-wiglet-by-wig-pro?variant=41297102045365&dc=BW35CSWP&gclid=CjwKCAjw0N6hBhAUEiwAXab-TbE1TeZcEj0PMEgnozLDZffK8cLuueMnlo2lhXv03txVCixYfV7p4RoCK6kQAvD_BwE.

Chinese National Intellectual Property Administration, Office Action in counterpart Chinese Patent Application No. 202330421584.X, mailed Mar. 19, 2024.

Chinese National Intellectual Property Administration, Office Action in counterpart Chinese Patent Application No. 202330421512.5, mailed Mar. 19, 2024.

Chinese National Intellectual Property Administration, Office Action in counterpart Chinese Patent Application No. 202330421450.8, mailed Mar. 22, 2024.

* cited by examiner

WEFT HAIR EXTENSION CLIPS AND ASSEMBLIES THEREOF

CROSS-REFERENCE TO RELATED APPLICATION

This application claims the benefit of priority of U.S. non-provisional application Ser. No. 29/697,926, filed 12 Jul. 2019, as a continuation thereof, the contents of which are herein incorporated by reference.

BACKGROUND OF THE INVENTION

The present invention relates to hair care accessories and, more particularly, a weft hair extension clip and a method of using the same.

Individuals use hair extensions to help with hair thinning and to add volume and density. Weft hair extensions add a substantial amount of artificial hair, making it easier to not only add volume and density but also enables different hair styles. Current methods and weft hair extension products do not create a secure hold because of the quantitative weight of the weft hair, causing the weft hair to slip out or become misaligned, which can be frustrating and embarrassing. Additionally, current weft hair extension clips only allow the user to place the weft hair in a downward angle, also due to the lack of a secure hold under the weight of the added weft of hair.

As can be seen, there is a need for a hair extension clip enabling different variations of the clip placement allowing the user to quickly snap on weft hair on to the top, the side and/or the back of head. The clips embodied by the present invention attaches the weft hair in a securely with a hugging effect, allowing the user to snap on and off the weft hair onto existing hair conveniently and confidently; the present invention facilitates snap on hair extensions with a secure hold.

SUMMARY OF THE INVENTION

In one aspect of the present invention, a clip assembly for weft hair extensions, the clip assembly includes: a planar base having a first surface and a second surface; one or more clips along the second surface; each clip having two end caps spaced apart and joined to the planar base; a frame extends between the two end caps so as to be movable between a convex inactive configuration and a concave active configuration; and one or more prongs extending from each end cap in such a way that the one or more prongs are movable between a skewed inactive mode and an intersected active mode, wherein each prong intersects a frame plane.

In another aspect of the present invention, the clip assembly for weft hair extensions further includes a weft hair attached to the first surface, wherein each end cap provides one or more holes; and further comprising a joining element joining the one or more holes and the planar base., wherein the joining element is stitching, wherein the one or more clips are two clips spaced apart in a horizontal colinear orientation, or wherein the one or more clips are four clips spaced apart in a grid orientation—i.e., the four clips are colinear horizontally and vertically along the second surface.

These and other features, aspects and advantages of the present invention will become better understood with reference to the following drawings, description and claims

DETAILED DESCRIPTION OF THE INVENTION

Figure 1:
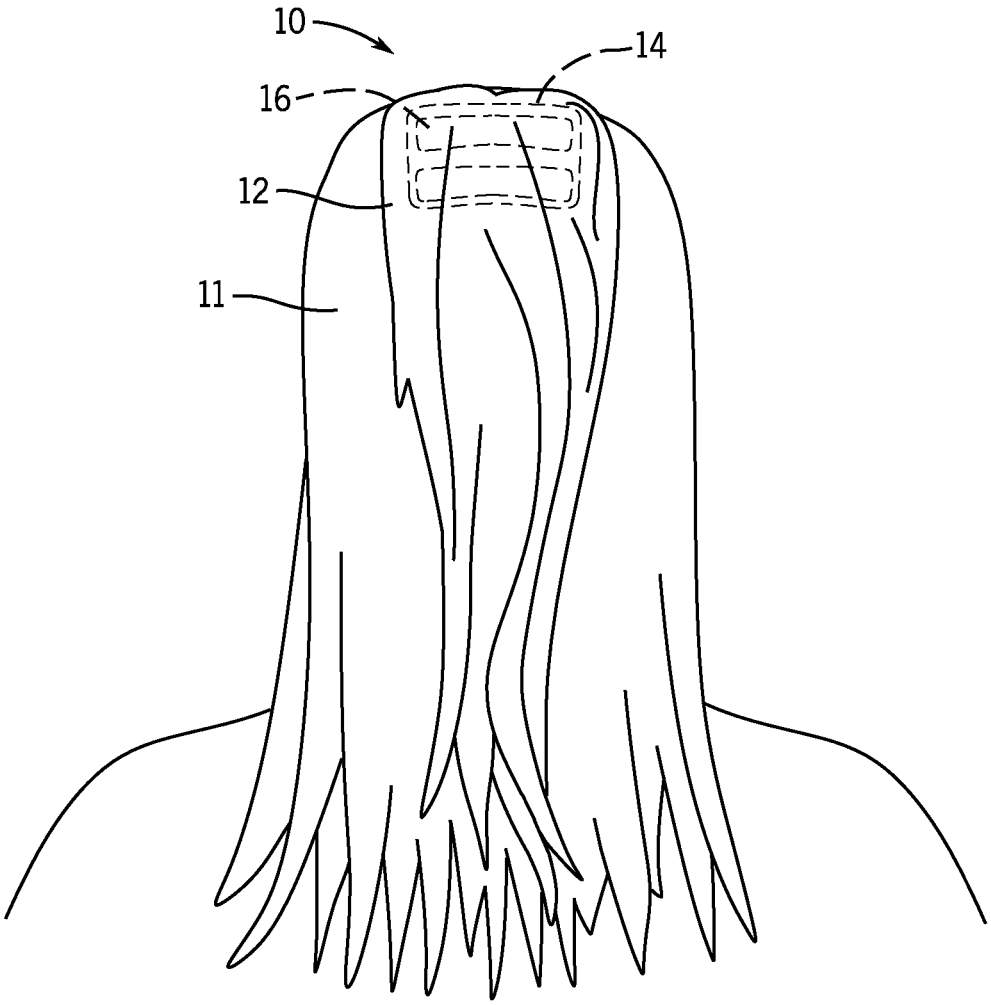
FIG. 1 is a rear elevation view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a weft hair extension clip assembly, system, and method of using the same. Each weft hair extension clip assembly has a planar base, along a first surface thereof the artificial weft hair is attached. On the second, opposing surface of the planar base is a frame joined thereto by opposing end caps for each clip of the weft hair extension assembly. Each end cap supports prongs movable between an inactive mode and an active mode, relative to the frame, where in the active mode the prongs intersect the plane of the frame in such a way as to urged hair of the user between the prongs and frame for a secure hold. The frame may also move in concert with the prongs from a convex configuration to a concave configuration hugging the head of the user in the active mode. The clip assembly may be paired, wherein each pair of clip assemblies is in a colinear orientation so that the end caps align horizontally and possible vertically, grid-like, in different embodiments.

Referring now to FIGS. 1 through 12, the present invention may include a weft hair extension clip 10. The weft hair extension clip 10 may include a weft of artificial hair 12 extending from (by way of an attachment medium 40, such as adhesive) a first surface of a planar base 14, 14*a*, or 14*b*. Along a second surface of a planar base 14, 14*a*, or 14*b*, a plurality of clip assemblies 16 are provided for removably attaching to a user's natural hair 11. The plurality of clip assemblies 16 may be secured to the second surface by way of support structure 20 afforded by the former and joining elements 22 joining the former and the latter. It should be noted that the support structure 20 may be holes 32*c* and the joining elements 22 may be stitching, but it should also be understood that the support structure and the joining elements 22 may be joining methodology capable of joining one object to another within the limitations of the present invention.

Figure 3:
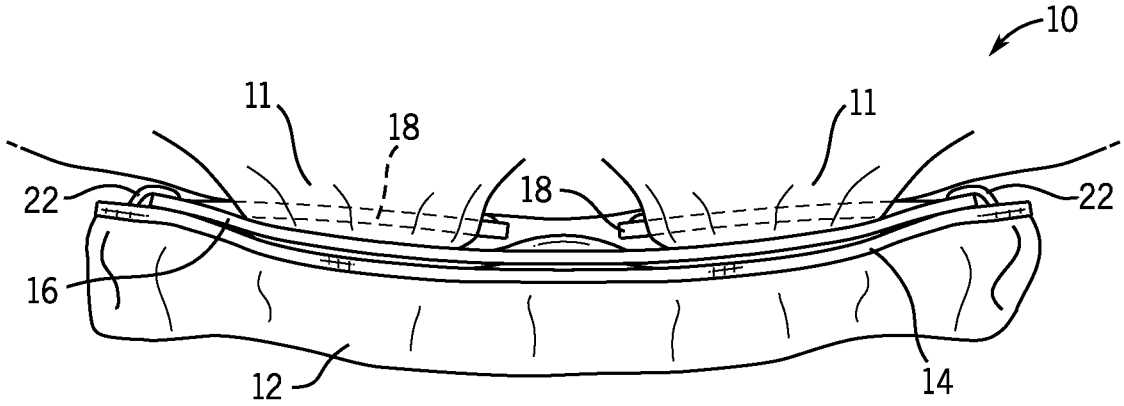
FIG. 3 is a side elevation view of an exemplary embodiment of the present invention, shown in use.

Each plurality of clip assemblies 16 has at least one pair of spaced apart snap on clip prongs 18 movable between an inactive mode 18*a* and an active mode urging a portion of the user's hair 11 against a frame (or frames) 30 of the clip assembly 16. The active mode is illustrated in FIG. 3, showing the snap on clip prongs 18 urging hair 11 against the frame 30 within a trap area 32*b*.

Figure 6:
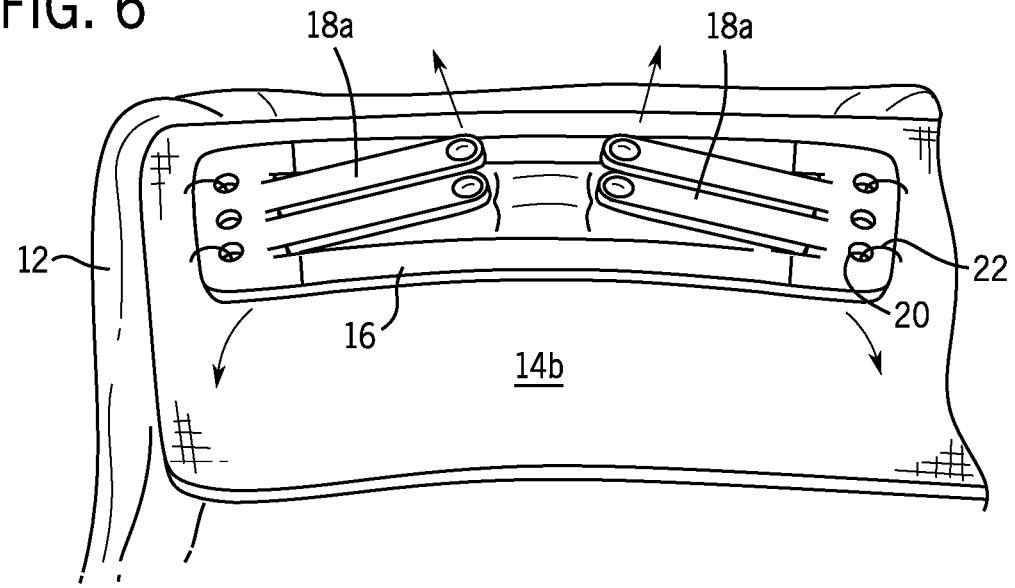
FIG. 6 is a detailed rear perspective view of an exemplary embodiment of the present invention, illustrating an inactive mode.
Figure 7:
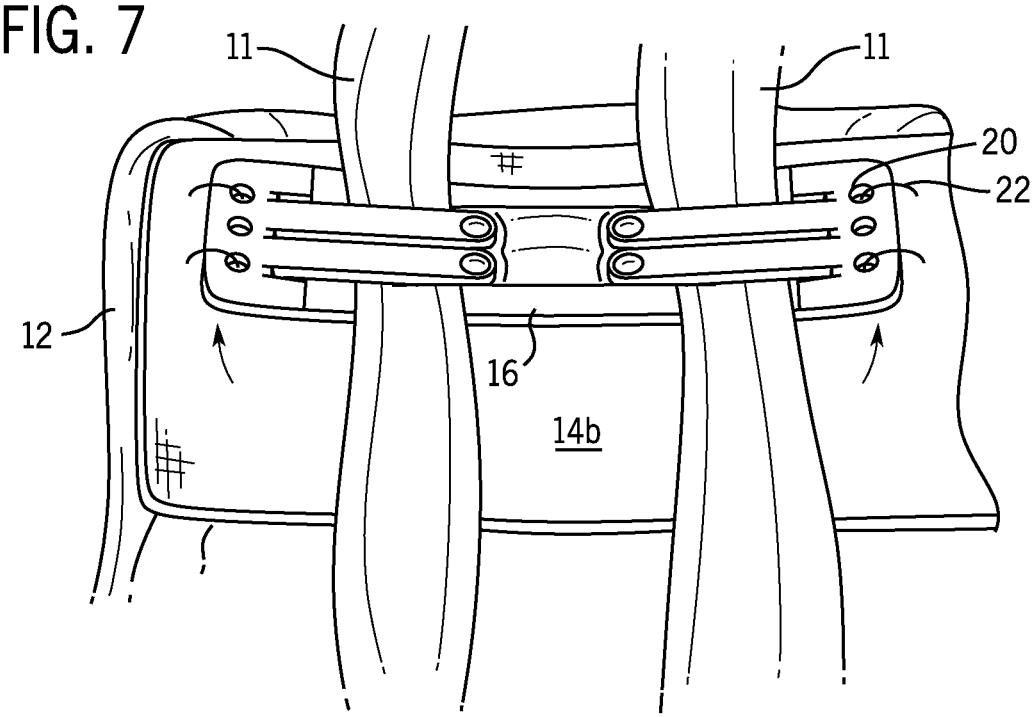
FIG. 7 is a detailed rear perspective view of an exemplary embodiment of the present invention, illustrating the active mode or "in use"
Figure 8:
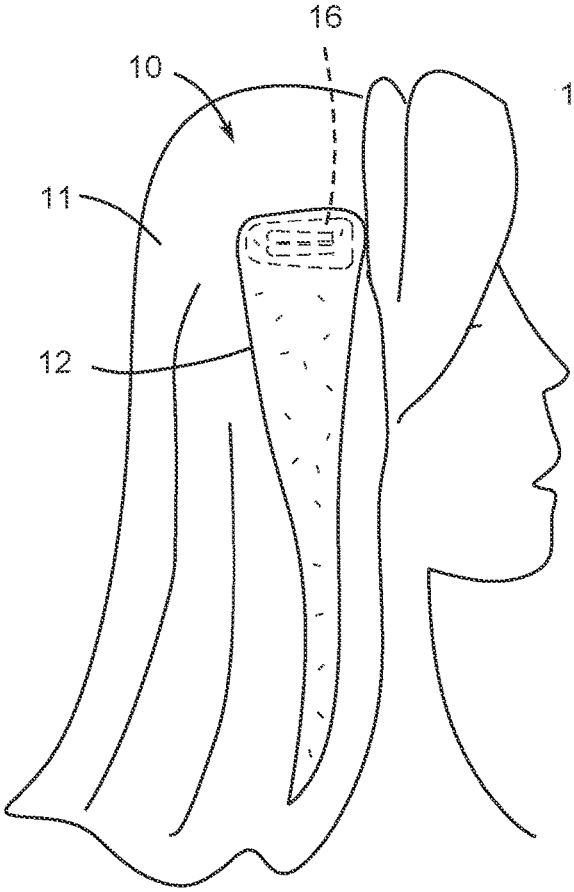
FIG. 8 is a front elevation view of an exemplary embodiment of the present invention, shown in use.
Figure 9:
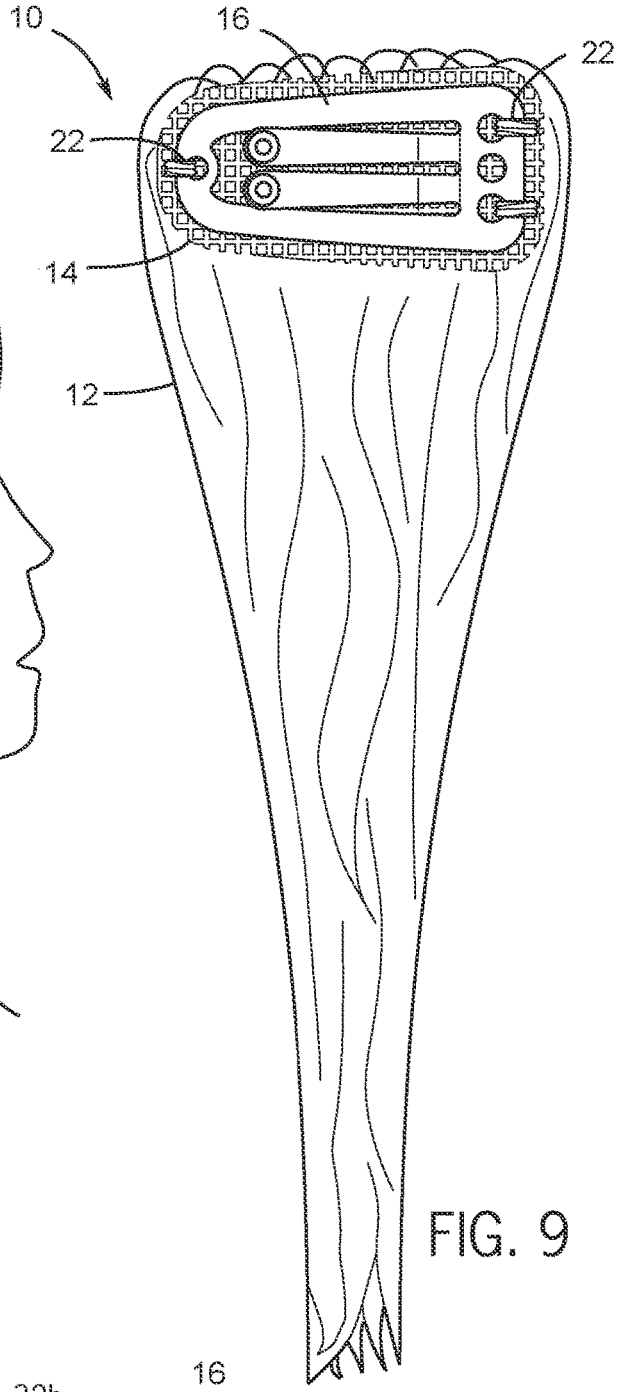
FIG. 9 is a rear elevation view of an exemplary embodiment of the present invention.
Figure 11:
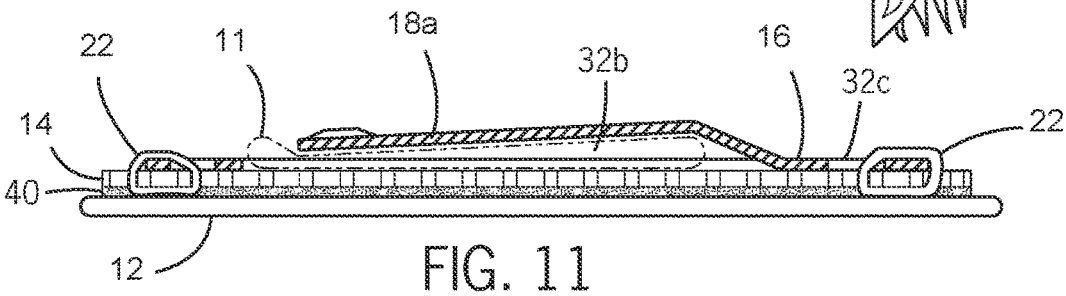
FIG. 11 is a section view of an exemplary embodiment of the present invention, taken along line 11-11 in FIG. 10.
Figure 10:
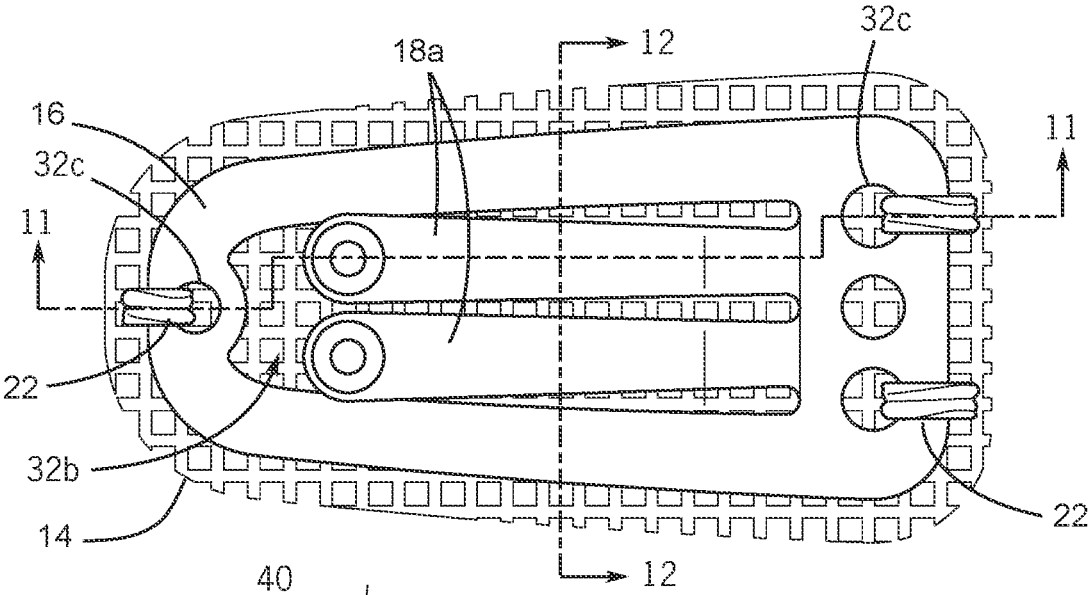
FIG. 10 is a rear elevation detail view of an exemplary embodiment of the present invention.
Figure 12:
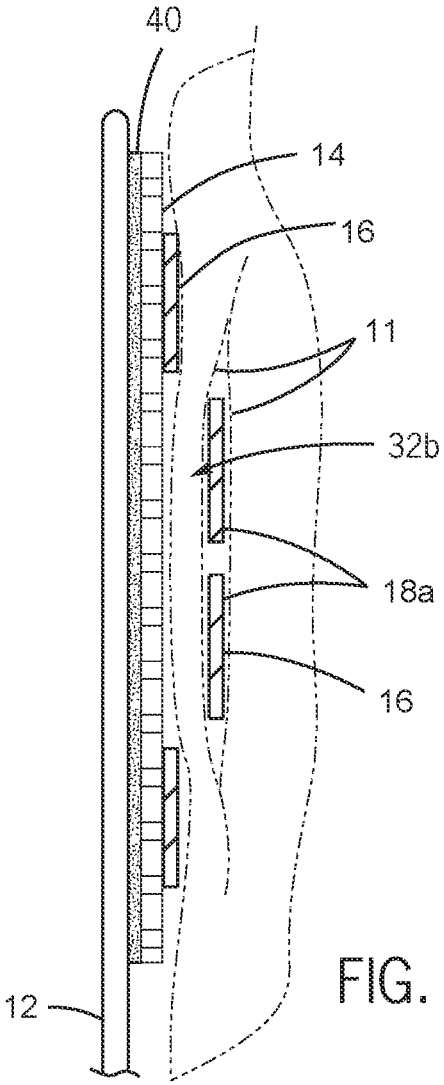
FIG. 12 is a section view of an exemplary embodiment of the present invention, taken along line 12-12 in FIG. 10.

FIG. 6 illustrates the inactive mode 18*a*, where the snap on clip prongs is out of plane and skew with the frame 30 so that the user's hair 11 can easily slide between the snap on clip prongs and the frame 30. In the active mode, illustrated in FIG. 7, the snap on clip prongs is in plane at so that there is a (planar) intersection with the frame 30 (or at least a plane defined by the frame, herein "frame plane"). It should be noted that the frame 30 may have a convex curvature in the inactive mode, while having a concave curvature in the active mode. Importantly, the snap on clip prongs extends from end caps 32 of the frame 30 in such a way that the distal end of the snap on clip prongs are free to move between the skew and intersecting conditions of the inactive and active modes, respectively.

Figure 2:
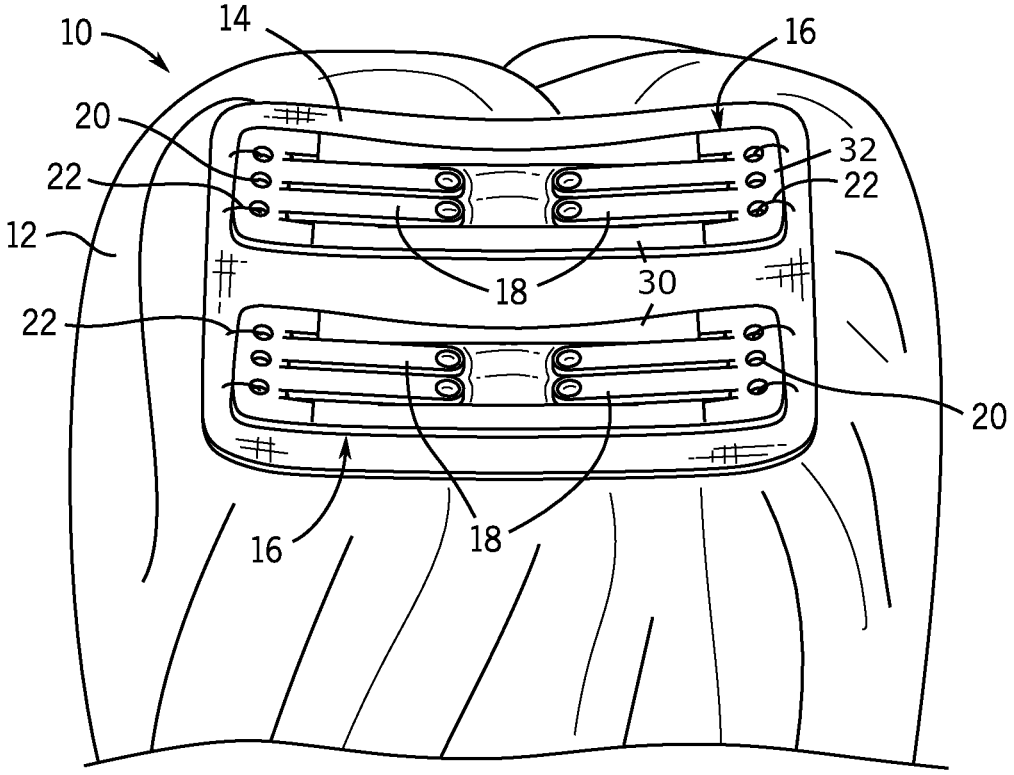
FIG. 2 is a detailed rear elevation view of an exemplary embodiment of the present invention.
Figure 4:
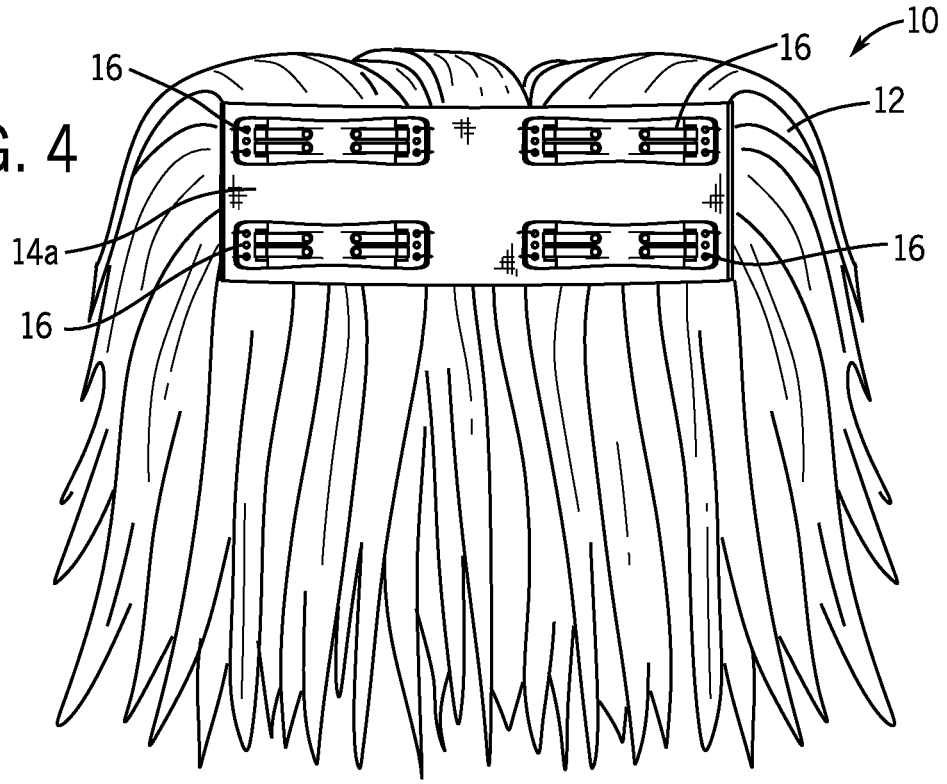
FIG. 4 is a rear elevation view of an exemplary embodiment of the present invention.
Figure 5:
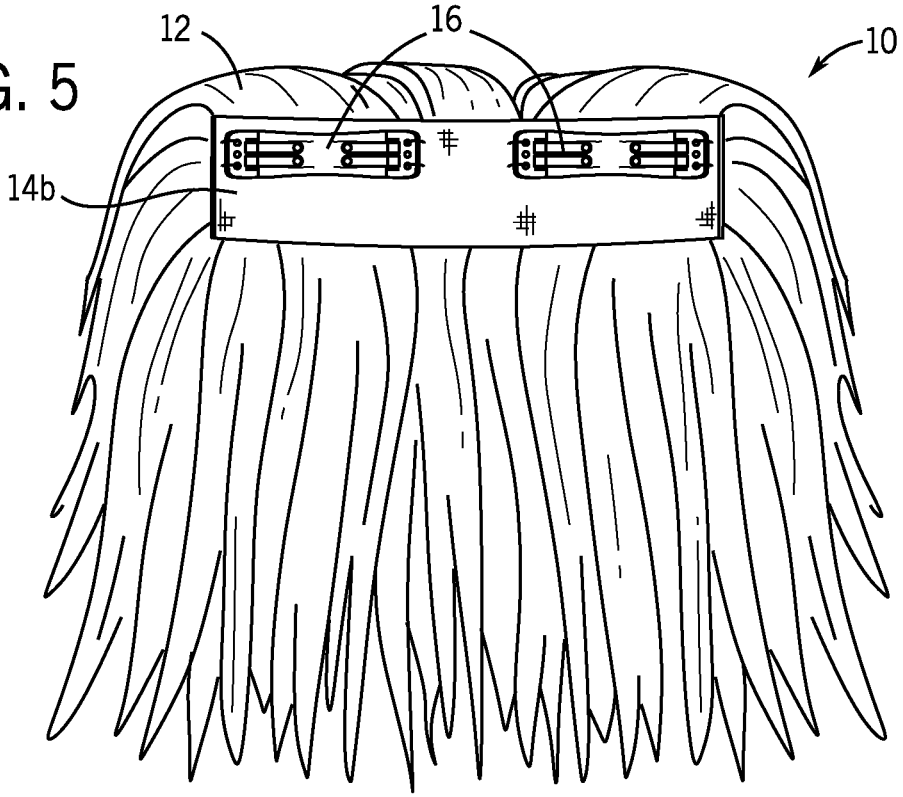
FIG. 5 is a rear elevation view of an exemplary embodiment of the present invention.

Also important, the end caps 32 provide the structure 20 for the joining elements 22 so that the end caps 32 (and not the frame 30) are joined to the planar base 14. The two opposing end caps 32 of each clip assembly 16 being fixed to the planar base 14 enables the two distinct skew and intersecting conditions. Similarly, the placement of each pair of clip assemblies 16 in a colinear orientations (vertical and/or horizontal—i.e., not off set), further facilitates the two distinct skew and intersecting conditions through providing an in-line balance of forces through the shared planar base 14, 14*a*, and/or 14*b*. The vertical and/or horizontal in-line/colinear orientations are maintained even with two pairs, as shown in FIGS. 2 and 4. Additionally, the concave curvature is also reinforced by the spaced apart end caps 32 being fixed to the planar base 14, thereby facilitated a hugging effect.

Referring to FIGS. 8 through 12, it is further illustrated an embodiment of the present invention featuring the weft hair extension clip 10 having only one clip 16, but otherwise having the similar structure and functionality as disclosed herein.

A method of using the present invention may include the following. The weft hair extension clip 10 disclosed above may be provided. A user may place the planar base 14 at a desired location along the head of the user, with the artificial har 12 facing outward. Then the user may then slide a separate portion of their hair 11 into each of the plurality of clip assemblies 16 in the inactive mode, and then move the snap on clip prongs 18 to the active moved, securing the extension clip 10 to the user's head by way of the hugging effect. Through the secure hold afforded by the hugging effect, the present invention allows the user to add hair to their existing hair creating more fullness and density, covering thinning spots, adding new colors and/or adding length, as well as allowing the user to add one or more weft hair extension on to the top, the side or the back of head and at more angles that just the standard downward angle.

It should be understood, of course, that the foregoing relates to exemplary embodiments of the invention and that modifications may be made without departing from the spirit and scope of the invention as set forth in the following claims.

What is claimed is:

1. A clip assembly for weft hair extensions, the clip assembly consisting of:

a planar base having a first surface and a second surface;

one or more clips along the second surface;

each clip including:

an integrally formed frame having:

a first end cap and a second end cap opposite the first end cap, with the first end cap and the second end cap joined to the planar base, and a first sidewall and a second sidewall extending between the first and second end caps;

wherein the frame defines a frame plane and is movable between a convex inactive configuration and a concave active configuration, and two prongs formed of unitary construction with and extending from the first end cap towards the second end cap and movable between a skewed inactive mode and an intersected active mode, wherein each is formed of unitary construction with and extends from the frame and substantially intersecting the frame plane when in the intersected active mode, and wherein each prong has a longitudinal length extending in a non-transverse direction to a longitudinal axis of the frame.

2. The clip assembly of claim 1, further consisting of a weft hair attached to the first surface.

3. The clip assembly of claim 1, wherein each end cap provides one or more holes; and further consisting of a joining element joining the one or more holes and the planar base.

4. The clip assembly of claim 3, wherein the joining element is stitching.

5. The clip assembly of claim 1, wherein the one or more clips are two clips spaced apart in a horizontal colinear orientation.

6. The clip assembly of claim 1, wherein the one or more clips are four clips spaced apart in a grid orientation.

7. The clip assembly of claim 6, wherein the four clips are colinear horizontally and vertically along the second surface.

8. A clip assembly for weft hair extensions, the clip assembly consisting of:

a planar base having a first surface and a second surface;

one or more clips along the second surface;

each clip including an integrally formed frame having a first end cap and a second end cap opposite the first end cap, with the first end cap and the second end cap joined to the planar base, and a first sidewall and a second sidewall extending between the first and second end caps;

wherein the frame defines a frame plane movable between an inactive configuration and an active configuration, and a first pair of prongs formed of unitary construction from a single material with and extending from the first end cap or the second end cap and movable between a skewed inactive mode and an intersected active mode, wherein each prong is formed of unitary construction from a single material with and extends from the frame and substantially intersects the frame plane when in the intersected active mode, and wherein each prong has a longitudinal length extending in a non-transverse direction to a longitudinal axis of the frame.

9. The clip assembly of claim 8, wherein the first pair of prongs extend from the first end cap towards the second end cap.

10. The clip assembly of claim 8, further consisting of a second pair of prongs integrally formed with the frame and extending from the second end cap towards the first end cap.

11. The clip assembly of claim 10, wherein a distal end of the first pair of prongs is spaced from a distal end of the second pair of prongs.

12. The clip assembly of claim 8, further consisting of a weft hair attached to the first surface.

13. The clip assembly of claim 8, wherein each of the first and second end caps provide one or more holes; and further consisting of a joining element joining the one or more holes and the planar base.

14. The clip assembly of claim 13, wherein the joining element is stitching.

15. The clip assembly of claim 8, wherein the one or more clips are two clips spaced apart in a horizontal colinear orientation.

16. The clip assembly of claim 8, wherein the one or more clips are four clips spaced apart in a grid orientation.

17. A clip assembly for weft hair extensions, the clip assembly consisting of:

a planar base having a first surface and a second surface;

one or more clips along the second surface, each clip including an integrally formed frame, the frame defining a frame plane movable between an inactive configuration and an active configuration, the frame including:

a first end cap having one or more prongs formed of unitary construction therewith and extending therefrom, and a second end cap opposite the first end cap, the second end cap having one or more prongs formed of unitary construction therewith and extending therefrom, wherein the frame comprises a substantially planar contiguous frame extending between the first and second end caps defining the frame plane.

18. The clip assembly of claim 17, wherein in the inactive configuration the prongs of each end cap are in a skewed inactive mode, and wherein in the active configuration the prongs of each end cap are in an intersected active move intersecting the frame.

19. The clip assembly of claim 18, wherein the frame is a substantially planar frame, and wherein each end cap includes one or more holes; and further consisting of:

a joining element joining the one or more holes and the planar base, and a weft hair attached to the first surface.

20. A weft hair extension comprising:

weft hair; and a clip assembly consisting of:

a planar base, and one or more clips along the planar base, each clip including:

an integrally formed frame having:

a first end cap and a second end cap opposite the first end cap, with the first end cap and the second end cap joined to the planar base, and a first sidewall and a second sidewall extending between the first and second end caps, wherein the integrally formed frame defines a frame plane and is movable between a convex inactive configuration and a concave active configuration, and two prongs extending from the first end cap towards the second end cap and movable between a skewed inactive mode and an intersected active mode, wherein each prong is formed of unitary construction with and extends from the frame, and wherein each prong has a longitudinal length extending in a non-transverse direction to a longitudinal axis of the frame.

* * * * *